US010246783B2

(12) United States Patent
Wu et al.

(10) Patent No.: US 10,246,783 B2
(45) Date of Patent: Apr. 2, 2019

(54) COPPER ETCHANT SOLUTION ADDITIVES AND METHOD FOR PRODUCING COPPER ETCHANT SOLUTION

(71) Applicant: Shenzhen China Star Optoelectronics Technology Co., Ltd., Shenzhen, Guangdong (CN)

(72) Inventors: Yue Wu, Guangdong (CN); Yu-lien Chou, Guangdong (CN); Zhichao Zhou, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 235 days.

(21) Appl. No.: 15/123,645

(22) PCT Filed: Jul. 11, 2016

(86) PCT No.: PCT/CN2016/089681
§ 371 (c)(1),
(2) Date: Sep. 4, 2016

(87) PCT Pub. No.: WO2017/219395
PCT Pub. Date: Dec. 28, 2017

(65) Prior Publication Data
US 2018/0171485 A1 Jun. 21, 2018

(51) Int. Cl.
*C23F 1/18* (2006.01)

(52) U.S. Cl.
CPC ..... *C23F 1/18* (2013.01)

(58) Field of Classification Search
CPC ..... C23F 1/18; H01L 21/31111; H01L 21/32134; H01L 21/02052
See application file for complete search history.

(56) References Cited

U.S. PATENT DOCUMENTS 5,419,351 A * 5/1995 Ciari ..... B08B 3/04 134/105
9,222,018 B1 * 12/2015 Casteel, Jr. ..... C09K 13/08
2011/0315658 A1 * 12/2011 Shibata ..... C23C 18/1601 216/37

(Continued)

FOREIGN PATENT DOCUMENTS

CN 1782132 A 6/2006
CN 103060810 A 9/2009
CN 101235290 A 8/2010

(Continued)

*Primary Examiner* — Duy Vu N Deo
(74) *Attorney, Agent, or Firm* — Andrew C. Cheng

(57) ABSTRACT

The present disclosure discloses a copper etchant solution additives and a method for producing copper etchant solution. The method includes: producing copper etchant solution additives, wherein the copper etchant solution additives is an inorganic solution with cupric ions (Cu2+), and deionized water is a solvent for the copper etchant solution additives and is electric neutrality; before wet-etching, the copper etchant solution additives is added in the copper etchant solution, and the copper etchant solution is with a cupric ions (Cu2+) concentration of 700-1000 ppm. Through the above method, the present disclosure can improve etchant property of copper etchant solution to increase etching rate and uniformity.

10 Claims, 1 Drawing Sheet

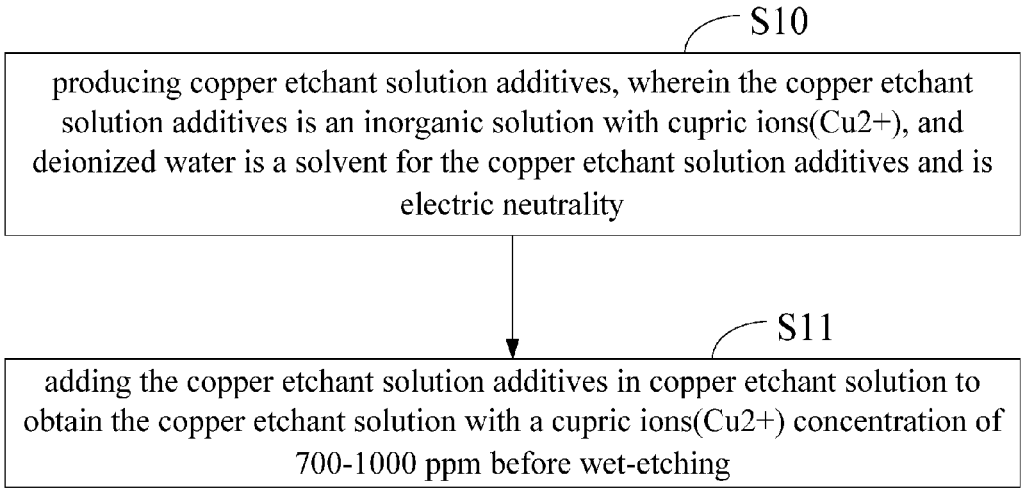

(56) References Cited

U.S. PATENT DOCUMENTS

2012/0319033 A1 12/2012 Okabe

FOREIGN PATENT DOCUMENTS

| | | | |
|---|---|---|---|
| CN | 103695908 | A | 4/2014 |
| CN | 104562013 | A | 4/2015 |
| CN | 105039985 | A | 11/2015 |
| JP | 5866566 | B2 | 1/2016 |

* cited by examiner

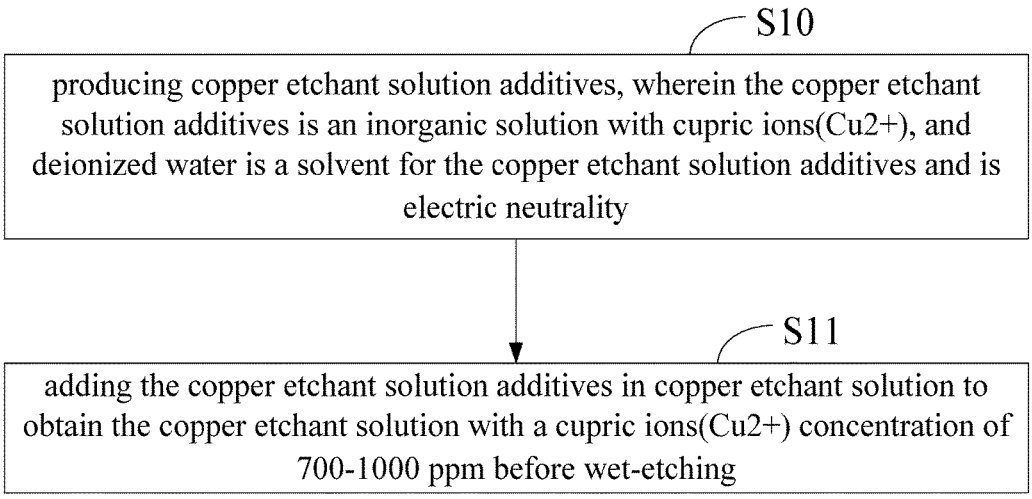
S10
producing copper etchant solution additives, wherein the copper etchant solution additives is an inorganic solution with cupric ions(Cu2+), and deionized water is a solvent for the copper etchant solution additives and is electric neutrality
S11
adding the copper etchant solution additives in copper etchant solution to obtain the copper etchant solution with a cupric ions(Cu2+) concentration of 700-1000 ppm before wet-etching

COPPER ETCHANT SOLUTION ADDITIVES AND METHOD FOR PRODUCING COPPER ETCHANT SOLUTION

FIELD OF THE INVENTION

The present disclosure is related to liquid crystal panel technical field, and particularly to copper etchant solution additives and a method for producing copper etchant solution.

DISCUSSION OF THE RELATED ART

The manufacturing process of liquid crystal panel includes Clean, Deposition, Exposure, Photolithography, Etching, Stripping and Testing; wherein Deposition includes Physical Vapor Deposition (PVD) and Chemical Vapor Deposition (CVD), and Etching includes wet-etching (WET) and dry-etching (DRY); wherein results of wet-etching (WET) have a great influence for precision of layout and quality of eventual panel. Most metal wires applied in traditional liquid crystal display devices are Aluminum or Aluminum alloy, and an etching solution system generally is a mixture of inorganic acid. With development of display technology, especially with development of display technology for large size and high resolution, traditional metal wire accompanying with problems of length of wire increasing, resistance increasing and thereby amplifier signal delay causes worse display effect. Furthermore, research for lower resistivity of metal wire which is copper processing is beginning. According to different properties of metal, the corresponding new kind of metal etchant solution is developed. Currently, copper etchant solution composed of hydrogen peroxide and a certain amount of additives and applied in actual manufacturing process is a mature technology.

However, during actual etching process, an unstable stage of etching performance is existed in the beginning of trial period for most etching solution. Further studies shows that the unstable stage is caused with increasing contents of cupric ions (Cu2+) of etching solution. Specifically, when contents of cupric ions (Cu2+) of etching solution increases, the etching ability of etching solution will be strengthened based on oxidability of cupric ions. As a result, contents of cupric ions of etching solution should be controlled effectively.

SUMMARY OF THE INVENTION

The disclosure provides a copper etchant solution additives and a method for producing copper etchant solution to improve etchant property of copper etchant solution to increase etching rate and uniformity.

The disclosure provides a method for producing copper etchant solution comprising: producing copper etchant solution additives, wherein the copper etchant solution additives is an inorganic solution with cupric ions (Cu2+), and deionized water is a solvent for the copper etchant solution additives and is electric neutrality; before wet-etching, the copper etchant solution additives is added in the copper etchant solution, and the copper etchant solution is with a cupric ions (Cu2+) concentration of 700-1000 ppm. Through the above method, the present disclosure can improve etchant property of copper etchant solution to increase etching rate and uniformity.

Wherein, the step of the copper etchant solution additives comprises: dissolving 18 g of copper sulfate pentahydrate in 100 g of water to form the copper etchant solution additives.

Wherein, the step of that the copper etchant solution additives is added in copper etchant solution before wet-etching comprises: adding 12.8 g of copper etchant solution additives in every 500 mL copper etchant solution to obtain the copper etchant solution with a cupric ions (Cu2+) concentration of 1000 ppm.

Wherein, the step of copper etchant solution additives comprises: dissolving 10 g of copper sulfate pentahydrate and 10 g of copper nitrate in 100 g of water to form the copper etchant solution additives.

Wherein, the step of that the copper etchant solution additives is added in copper etchant solution before wet-etching comprises: adding 10 g of copper etchant solution additives in every 500 mL copper etchant solution to obtain the copper etchant solution with a cupric ions (Cu2+) concentration of 1000 ppm.

The present disclosure further provides a copper etchant solution additives, wherein the copper etchant solution additives is an inorganic solvent comprising cupric ions (Cu2+), deionized water is a solvent for the copper etchant solution additives and is electric neutrality, and the copper etchant solution additives is added in a copper etchant solution before wet-etching to obtain the copper etchant solution with a cupric ions (Cu2+) concentration of 700-1000 ppm.

Wherein, the copper etchant solution additives is aqueous copper sulfate formed by dissolving 18 g of copper sulfate pentahydrate in 100 g of water.

Wherein, the copper etchant solution contains 12.8 g of copper etchant solution additives in every 500 mL of copper etchant solution, and is with a cupric ions (Cu2+) concentration of 1000 ppm.

Wherein, the copper etchant solution additives is an aqueous solution of both copper sulfate and copper nitrate, and is formed by dissolving 10 g of copper sulfate pentahydrate and 10 g of copper nitrate in 100 g of water.

Wherein, the copper etchant solution contains 10 g of copper etchant solution additives in every 500 mL of copper etchant solution, and is with a cupric ions (Cu2+) concentration of 1000 ppm.

Through the above solutions, the present disclosure provides with the following benefits: the copper etchant solution additives of the present disclosure is an inorganic solution with cupric ions (Cu2+), deionized water is a solvent for the copper etchant solution additives and is electric neutrality, and the copper etchant solution additives is added in a copper etchant solution before wet-etching to obtain a cupric ions (Cu2+) concentration with 700-1000 ppm to improve properties of copper etchant solution and increase etching rate and uniformity.

BRIEF DESCRIPTION OF THE DRAWINGS

To describe the technical solutions of embodiments of the present disclosure more clearly, the attached drawings necessary for description of the embodiments will be introduced briefly herein below. Obviously, these attached drawings only illustrate some of the embodiments of the present disclosure, and thoses of ordinary skill in the art can further obtain other attached drawings according to these attached drawings without making inventive efforts. In the attached drawings:

FIG. 1 is a schematic flow chart of a method for producing copper etchant solution according the present disclosure.

DETAILED DESCRIPTION OF THE ILLUSTRATED EMBODIMENTS

To make objectives, technical solution and advantages of the present disclosure clearer, technical solutions in the embodiments of the present disclosure are described clearly and completely in the following with reference to accompanying drawings in the embodiments of the present disclosure. Apparently, the described embodiments are merely part rather than all of the embodiments of the present disclosure. All other embodiment of the present disclosure without creative efforts shall fall within the protection scope of the present disclosure.

In the embodiment of the present disclosure, the copper etchant solution additives is an inorganic solvent comprising cupric ions (Cu2+), deionized water is a solvent for the copper etchant solution additives and is electric neutrality, and the copper etchant solution additives is added in a copper etchant solution before wet-etching to obtain the copper etchant solution with a cupric ions (Cu2+) concentration of 700-1000 ppm.

In the copper etchant solution of the embodiment of the present disclosure, anions are one element or at least one element from chlorine, bromine, sulfate, nitrate and etc., the whole solution is electric neutrality, and then the cupric ions (Cu2+) are all electrolytic without forming complexes or depositions. The solution concentration is calculated according to cupric ions which is larger from 800 ppm to solubility extremity of cupric ions. The usage method is: adding the copper etchant solution additives before wet-etching and then mixing homogeneously for 10~30 min stably to increase the etching concentration of cupric ions to about 700-1000 ppm, therefore stable etching efficiency can be achieved.

In the embodiment of the present invention, the copper etchant solution additives is aqueous copper sulfate formed by dissolving 18 g of copper sulfate pentahydrate in 100 g of water and then being mixed homogeneously to obtain a blue solution. The copper etchant solution contains 12.8 g of copper etchant solution additives in every 500 mL of copper etchant solution, and is with a cupric ions (Cu2+) concentration of 1000 ppm. Therefore, the copper etchant solution obtained from the aforementioned method can achieve a stable etching efficiency to increase properties of the etching solution and improve both etching rate and uniformity.

The copper etchant solution additives can also be an aqueous solution of both copper sulfate and copper nitrate and is formed by dissolving 10 g of copper sulfate pentahydrate and 10 g of copper nitrate in 100 g of water, and then being mixed homogeneously to obtain a blue solution. The copper etchant solution contains 12.8 g of copper etchant solution additives in every 500 mL of copper etchant solution, and is with a cupric ions (Cu2+) concentration of 1000 ppm. Therefore, the copper etchant solution obtained from the aforementioned method can achieve a stable etching efficiency to increase properties of the etching solution and improve both etching rate and uniformity.

FIG. 1 is a schematic flow chart of a method for producing copper etchant solution according the present disclosure. As shown in FIG. 1, the method for producing copper etchant solution comprises:

Step 10: producing copper etchant solution additives, wherein the copper etchant solution additives is an inorganic solution with cupric ions (Cu2+), and deionized water is a solvent for the copper etchant solution additives and is electric neutrality.

In Step 10, the copper etchant solution additives can be formed by dissolving 18 g of copper sulfate pentahydrate in 100 g of water to form the copper etchant solution additives and then being mixed homogeneously to obtain a blue solution. Otherwise, the copper etchant solution additives can also be formed by dissolving 10 g of copper sulfate pentahydrate and 10 g of copper nitrate in 100 g of water to form the copper etchant solution additives and then being mixed homogeneously to obtain a blue solution.

Step 11: before wet-etching, the copper etchant solution additives is added in the copper etchant solution, and the copper etchant solution is with a cupric ions (Cu2+) concentration of 700-1000 ppm.

In the copper etchant solution of the present disclosure, anions are one element or at least one element from chlorine, bromine, sulfate, nitrate and etc., the whole solution is electric neutrality, and then the cupric ions (Cu2+) are all electrolytic without forming complexes or depositions. The solution concentration is calculated according to cupric ions which is larger from 800 ppm to solubility extremity of cupric ions. The usage method is: adding the copper etchant solution additives before wet-etching and then mixing homogeneously for 10~30 min stably to increase the etching concentration of cupric ions to about 700-1000 ppm, therefore stable etching efficiency can be achieved.

Particularly, in Step 11, before wet-etching, the copper etchant solution contains 12.8 g of copper etchant solution additives in every 500 mL of copper etchant solution, and is with a cupric ions (Cu2+) concentration of 1000 ppm. Therefore, the copper etchant solution obtained from the aforementioned method can achieve a stable etching efficiency to increase properties of the etching solution and improve both etching rate and uniformity.

Otherwise, before wet-etching, the copper etchant solution contains 10 g of copper etchant solution additives in every 500 mL of copper etchant solution, and is with a cupric ions (Cu2+) concentration of 1000 ppm. Therefore, the copper etchant solution obtained from the aforementioned method can achieve a stable etching efficiency to increase properties of the etching solution and improve both etching rate and uniformity.

In summary, the copper etchant solution additives is an inorganic solution with cupric ions (Cu2+), and deionized water is a solvent for the copper etchant solution additives and is electric neutrality; before wet-etching, the copper etchant solution additives is added in the copper etchant solution, and the copper etchant solution is with a cupric ions (Cu2+) concentration of 700-1000 ppm to increase properties of the etching solution and improve both etching rate and uniformity.

The foregoing embodiment is merely used for describing the technical solution of the present disclosure, but not intended to limiting the present disclosure. Although the present disclosure is illustrated in detail with reference to the foregoing embodiments, persons of ordinary skill in the art should understand that they can still make modifications to the technical solutions described in the foregoing embodiments, or make equivalent substitutions to some technical features of the technical solutions; such modifications or equivalent substitution do not make essence of the corresponding technical solutions depart from the scope of the technical solutions of the embodiments of the present disclosure.

The invention claimed is:

1. A method for producing copper etchant solution, the production method comprising:

producing copper etchant solution additives, wherein the copper etchant solution additives is an inorganic solution with cupric ions (Cu2+), and deionized water is a solvent for the copper etchant solution additives and is electric neutrality;

adding the copper etchant solution additives in copper etchant solution to obtain the copper etchant solution with a cupric ions (Cu2+) concentration of 700-1000 ppm before wet-etching, wherein the cupric ions (Cu2+) in the copper etchant solution are all electrolytic without forming complexes or depositions.

2. The method of claim 1, wherein the step of producing the copper etchant solution additives comprises:

dissolving 18 g of copper sulfate pentahydrate in 100 g of water to form the copper etchant solution additives.

3. The method of claim 2, wherein the step of that the copper etchant solution additives is added in copper etchant solution before wet-etching comprises:

adding 12.8 g of copper etchant solution additives in every 500 mL copper etchant solution to obtain the copper etchant solution with a cupric ions (Cu2+) concentration of 1000 ppm.

4. The method of claim 1, wherein the step of producing copper etchant solution additives comprises:

dissolving 10 g of copper sulfate pentahydrate and 10 g of copper nitrate in 100 g of water to form the copper etchant solution additives.

5. The method of claim 4, wherein the step of that the copper etchant solution additives is added in copper etchant solution before wet-etching comprises:

adding 10 g of copper etchant solution additives in every 500 mL of copper etchant solution to obtain the copper etchant solution with a cupric ions (Cu2+) concentration of 1000 ppm.

6. A copper etchant solution additives, wherein the copper etchant solution additives is an inorganic comprising cupric ions (Cu2+), deionized water is a solvent for the copper etchant solution additives and is electric neutrality, and the copper etchant solution additives is added in a copper etchant solution before wet-etching to obtain the copper etchant solution with a cupric ions (Cu2+) concentration of 700-1000 ppm, wherein the cupric ions (Cu2+) in the copper etchant solution are all electrolytic without forming complexes or depositions.

7. The copper etchant solution additives of claim 6, wherein the copper etchant solution additives is aqueous copper sulfate formed by dissolving 18 g of copper sulfate pentahydrate in 100 g of water.

8. The copper etchant solution additives of claim 7, wherein the copper etchant solution contains 12.8 g of copper etchant solution additives in every 500 mL of copper etchant solution, and is with a cupric ions (Cu2+) concentration of 1000 ppm.

9. The copper etchant solution additives of claim 6, wherein the copper etchant solution additives is an aqueous solution of both copper sulfate and copper nitrate, and is formed by dissolving 10 g of copper sulfate pentahydrate and 10 g of copper nitrate in 100 g of water.

10. The copper etchant solution additives of claim 9, wherein the copper etchant solution contains 10 g of copper etchant solution additives in every 500 mL of copper etchant solution, and is with a cupric ions (Cu2+) concentration of 1000 ppm.

* * * * *